US006961171B2

(12) United States Patent
Byren et al.

(10) Patent No.: US 6,961,171 B2
(45) Date of Patent: Nov. 1, 2005

(54) PHASE CONJUGATE RELAY MIRROR APPARATUS FOR HIGH ENERGY LASER SYSTEM AND METHOD

(75) Inventors: Robert W. Byren, Manhattan Beach, CA (US); David Filgas, Newbury Park, CA (US)

(73) Assignee: Raytheon Company, Waltham, MA (US)

( * ) Notice: Subject to any disclaimer, the term of this patent is extended or adjusted under 35 U.S.C. 154(b) by 232 days.

(21) Appl. No.: 10/272,778

(22) Filed: Oct. 17, 2002

(65) Prior Publication Data

US 2004/0075884 A1 Apr. 22, 2004

(51) Int. Cl.[7] ..... H01S 3/00
(52) U.S. Cl. ..... 359/333; 359/338
(58) Field of Search ..... 359/338, 333; 250/201.9

(56) References Cited

U.S. PATENT DOCUMENTS

| | | | | |
|---|---|---|---|---|
| 4,734,911 A | | 3/1988 | Bruesselbach | |
| 4,798,462 A | | 1/1989 | Byren | |
| 4,812,639 A | | 3/1989 | Byren et al. | |
| 4,853,528 A | | 8/1989 | Byren et al. | |
| 4,949,056 A | * | 8/1990 | Akkapeddi | 359/334 |
| 5,126,876 A | | 6/1992 | O'Meara | |
| 5,208,699 A | | 5/1993 | Rockwell et al. | |
| 5,483,342 A | | 1/1996 | Rockwell | |
| 5,557,347 A | | 9/1996 | Johnson | |

FOREIGN PATENT DOCUMENTS

DE 010049275 A1 * 4/2002

EP 000952642 A2 * 10/1999

OTHER PUBLICATIONS

Hartman et al., "EAGLE: Relay mirror Technology development", Proc. SPIE, vol. 4724, pp. 110–115, Apr. 1, 2002.

* cited by examiner

*Primary Examiner*—Mark Hellner
(74) *Attorney, Agent, or Firm*—John E. Guther; Leonard A. Alkov; Karl A. Vick

(57) ABSTRACT

A system for directing electromagnetic energy. The inventive system includes a first subsystem mounted on a first platform for transmitting a beam of the electromagnetic energy through a medium and a second subsystem mounted on a second platform for redirecting the beam. In accordance with the invention, the second platform is mobile relative to the first platform. In the illustrative embodiment, the beam is a high-energy laser beam. The first subsystem includes a phase conjugate mirror in optical alignment with a laser amplifier. The first subsystem further includes a beam director in optical alignment with the amplifier and a platform track sensor coupled thereto. In the illustrative embodiment, the second subsystem includes a co-aligned master oscillator, outcoupler, and target track sensor which are fixedly mounted to a stabilized platform, a beam director, and a platform track sensor. In the best mode, the stable platform is mounted for independent articulation relative to the beam director. A first alternative embodiment of the second subsystem includes first and second beam directors. The first beam director is adapted to receive the transmitted beam and the second beam director is adapted to redirect the received beam. In accordance with a second alternative embodiment, an optical fiber is provided for coupling the beam between the first platform and the second platform.

23 Claims, 7 Drawing Sheets

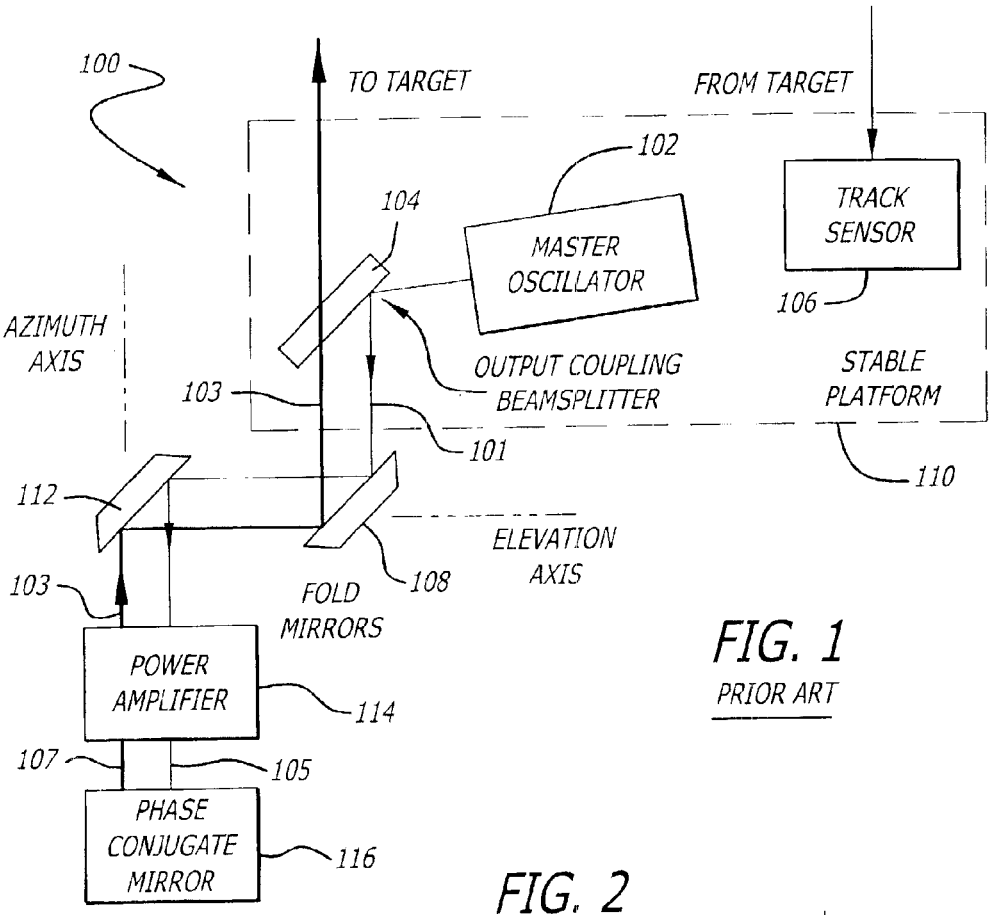
FIG. 1
PRIOR ART
FIG. 2
PRIOR ART
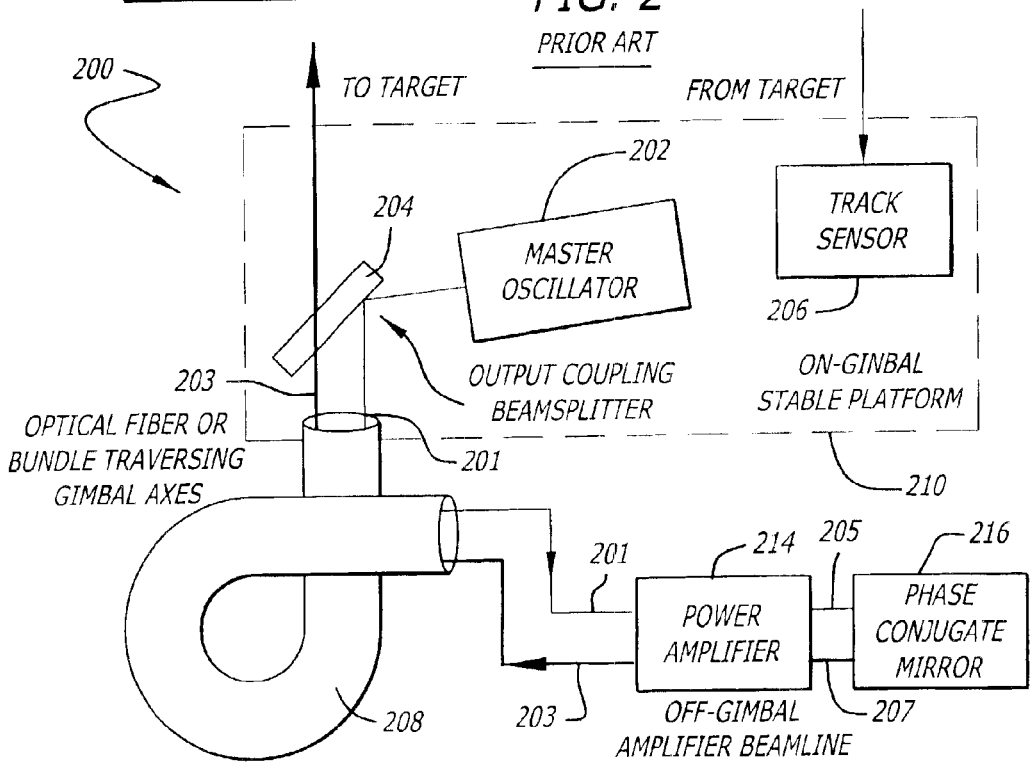

PHASE CONJUGATE RELAY MIRROR APPARATUS FOR HIGH ENERGY LASER SYSTEM AND METHOD

BACKGROUND OF THE INVENTION

1. Field of the Invention

The present invention relates to systems and methods for directing electromagnetic energy. More specifically, the present invention relates to high-energy lasers and optical arrangements therefor.

2. Description of the Related Art

High-energy lasers are currently being used for, numerous military applications including point and area defense along with numerous offensive roles. Unfortunately, high-energy laser systems are typically expensive, heavy and quite large. These systems typically consume a large amount of prime power and present a high thermal load to a host platform.

When used for surface ship self protection, a high-energy laser would suffer from atmospheric absorption, scattering and turbulence. For this application, incoming threats are attacked head-on, creating a targeting challenge and attacking the threat where it is least vulnerable. In addition, high-energy lasers located at the deck level of a ship have a limited visible horizon and therefore provide a somewhat limited 'keep out' distance.

Airborne platforms with high-energy lasers are conventionally somewhat vulnerable and expensive and may place an air crew in harm's way.

Thus, a need exists in the art for an inexpensive, lightweight system or method for deploying a high-energy laser with minimal exposure of the warfighter.

SUMMARY OF THE INVENTION

The need in the art is addressed by the system for directing electromagnetic energy of the present invention. The invention addresses the problem of placing a large, high power consumption, high thermal load high-energy laser (HEL) system on an airborne platform. For surface ship self protection, an airborne platform is advantageous for several reasons: (1) it provides a better atmospheric transmission path (lower absorption, lower scattering, less turbulence); (2) it allows threats such as anti-ship cruise missiles to be attacked from the side where they are more vulnerable; and (3) it provides a longer keep-out distance due to the longer visible horizon. For ground attack, an airborne platform provides a large engagement zone and can operate behind enemy lines. Manned aircraft, however, put the air crew in harm's way. Large manned platforms and Unmanned Combat Air Vehicles (UCAV) required to carry a full HEL system payload are more vulnerable and less expendable than smaller unmanned airborne vehicles (UAVs), which are typically used as sensor platforms. The problem is to achieve a HEL self defense or ground attack capability from a small, inexpensive remotely piloted vehicle (RPV) platform.

The inventive system includes a first subsystem mounted on a first platform for transmitting a beam of the electromagnetic energy through a medium and a second subsystem mounted on a second platform for redirecting the beam. In accordance with the invention, the second platform may be mobile relative to the first platform.

In the illustrative embodiment, the beam is a high-energy laser (HEL) beam. The first subsystem includes a phase conjugate mirror in optical alignment with a laser amplifier. The first subsystem further includes a beam director in optical alignment with the amplifier and a platform track sensor coupled thereto. In the illustrative embodiment, the second subsystem includes a co-aligned laser master oscillator, target track sensor, and outcoupler arrangement fixedly mounted to a stabilized platform; a beam director: and a platform track sensor. In the best mode, the stabilized platform is mounted on the inner gimbal of the beam director such that the line of sight from the beam director portion of the first subsystem can be articulated to coincide with the target. The function of the second subsystem is similar to that of an orbiting relay mirror as described in the Tom Clancy novel *The Cardinal of the Kremlin*, pp. 43 and 147, Berkley Books (paperback), 1988 and by Friedman, et al in *Advanced Technology Warfare*, pp. 84–85, Harmony Books, New York, 1985.

A first alternative embodiment of the second subsystem includes first and second beam directors. The first beam director is adapted to receive the transmitted beam and the second beam director is adapted to redirect the received beam. In this embodiment, the laser master oscillator, target track sensor, outcoupler and both beam directors are fixedly mounted to the first platform.

In accordance with a second alternative embodiment, an optical fiber is provided for coupling the beam between the first platform and the second platform.

BRIEF DESCRIPTION OF THE DRAWINGS

FIG. 1 is a block diagram showing a self-aligning phase conjugate laser concept implemented in accordance with conventional teachings.

FIG. 2 is an alternate embodiment of the self-aligning phase conjugate laser concept illustrated in FIG. 1.

DESCRIPTION OF THE INVENTION

Figure 3:
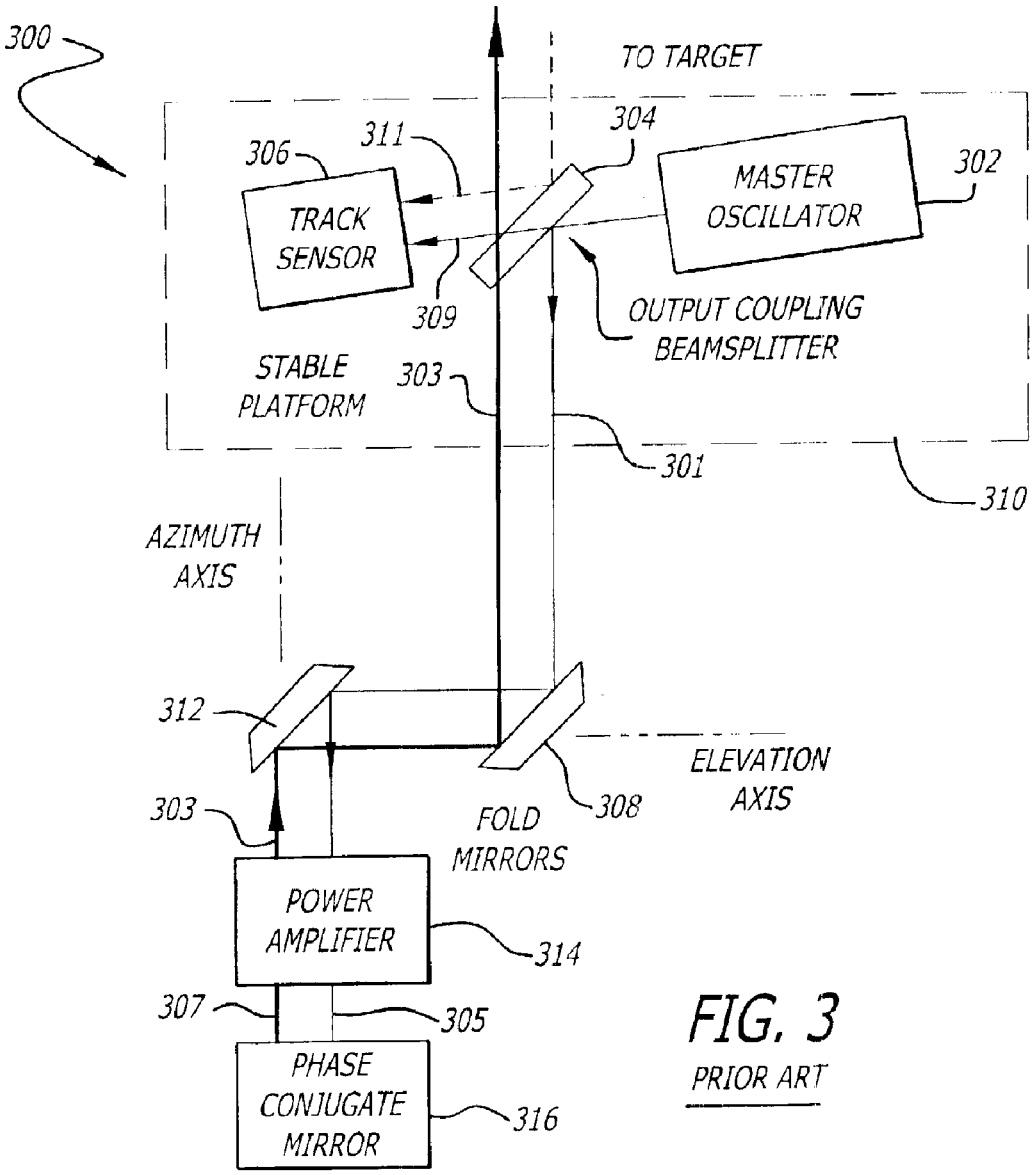
FIG. 3 PRIOR ART
FIG. 3 is a block diagram showing an auto-boresight technique for the self-aligning phase conjugate laser implemented in accordance with conventional teachings.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

The teachings of the present invention are best appreciated with a brief review of certain prior teachings.

FIG. 1 is a block diagram showing a self-aligning phase conjugate laser concept disclosed by Byren and Rockwell in the early 1980s (U.S. Pat. Nos. 4,812,639 and 4,853,528) the teachings of which are incorporated herein by reference. This concept is based on the phase conjugate master oscillator/power amplifier (PC MOPA) approach disclosed in numerous predecessor patents, e.g., Bruesselbach in U.S. Pat. No. 4,734,911 entitled "Efficient Phase Conjugate Laser" the teachings of which are incorporated herein by reference.

In the embodiment of FIG. 1, a small master oscillator 102 is located on the innermost gimbal (or stabilized platform) 110 of a high power laser pointing and tracking system 100. A phase conjugate laser amplifier 114 is located off gimbal. An output coupling beamsplitter or "outcoupler" 104 is used (1) to insert a beam 101 from a master oscillator 102 into a phase conjugate leg, defined between the outcoupler 104 and a phase conjugate mirror 116 and (2) to extract the high power beam 103 out of the phase conjugate leg after amplification.

An optional second harmonic generation (SHG) crystal is also described in this patent and the predecessors, which advantageously converts the laser wavelength for certain in-band anti-sensor applications while preserving high beam quality at the converted wavelength.

Several methods of outcoupling may be used depending on the application, dichroic (for the SGH option), polarization beamsplitting (as in Bruesselbach), interferometric/polarization (as in Rockwell, U.S. Pat. No. 5,483,342 entitled "Polarization Rotator with Frequency Shifting Phase Conjugate Mirror and Simplified Interferometric Outcoupler"), and interferometric (as in O'Meara, U.S. Pat. No. 5,126,876 entitled "Master Oscillator Power Amplifier with Interference isolated Oscillator"). The teachings of these references are incorporated herein by reference as well.

The master oscillator 102 is aligned with reference to the optical line-of-sight of a target track sensor 106 such that, after reflection off the outcoupler optic 104, the oscillator beam 101 travels along the common track sensor line-of-sight but in a direction opposite the target. The oscillator beam is then routed along a Coudé path through the coarse gimbals to a location off-gimbal where it passes through the laser power amplifier beamline 114 and into the phase conjugate mirror 116.

At this point the beam 105 has been distorted by thermal lensing, wedging, and stress birefringence within the power amplifier, and its line-of sight has been deviated by thermal and structural compliance of the gimbals and optical bench, wobble (or runout) in the gimbal bearings, gimbal axis non-orthogonality, and base motion coupled into the gimbals through bearing friction/stiction and cable spring forces.

The phase conjugate mirror 116 reverses the wavefront of the amplified beam 105 upon reflection, producing a phase conjugate return beam 107 that self-compensates for all of the aforementioned optical aberrations and gimbal line-of-sight errors as it retraces the path through the distorting elements. The high power beam 103 that emerges through the outcoupler 104 is therefore aligned with the injected oscillator beam 101 and is pointed in precisely the same direction as the track sensor 106 line-of-sight. The laser system 100 is thereby able to accurately engage targets simply by pointing the tracker to the aimpoint. This approach obviates the need for precision active auto-alignment systems used previously to compensate line-of-sight errors in the gimbal and provides alignment correction automatically and with the high bandwidth of the phase conjugate mirror.

FIG. 2 is an alternate embodiment of the self-aligning phase conjugate laser concept illustrated in FIG. 1. In this embodiment, the optical path through the gimbal trunions is implemented with a large core optical fiber or bundle of optical fibers 208. Again, a phase conjugate mirror 216 corrects all of the phase distortions and depolarization between the outcoupler 204 and phase conjugate mirror 216, which now includes the fiber 208. As in the first embodiment, the high power beam 203 that emerges remains aligned to the injected oscillator beam without the need for complex auto-alignment systems.

FIG. 3 is a block diagram showing an auto-boresight technique for the self-aligning phase conjugate laser, disclosed by Byren in U.S. Pat. No. 4,798,462. In this reference, the tracker is oriented to view the target by reflection off the same outcoupler device used in the self-aligning phase conjugate laser described above. A portion 309 of the master oscillator beam 301 is allowed to leak through the outcoupler 304 in order to provide a fudicial reference for the laser line of sight. This fudicial reference is sensed by the tracker (which must operate in-band to the laser) and is used as the boresight reference (or crosshairs) for tracking the target. Due to the reflection symmetry at the outcoupler 304, when the target aimpoint line of sight 311 is aligned with the oscillator beam fudicial reference, the high power beam 303 will hit the target aimpoint. With this approach, boresight errors associated with the oscillator, outcoupler, and tracker are automatically corrected.

Figure 4:
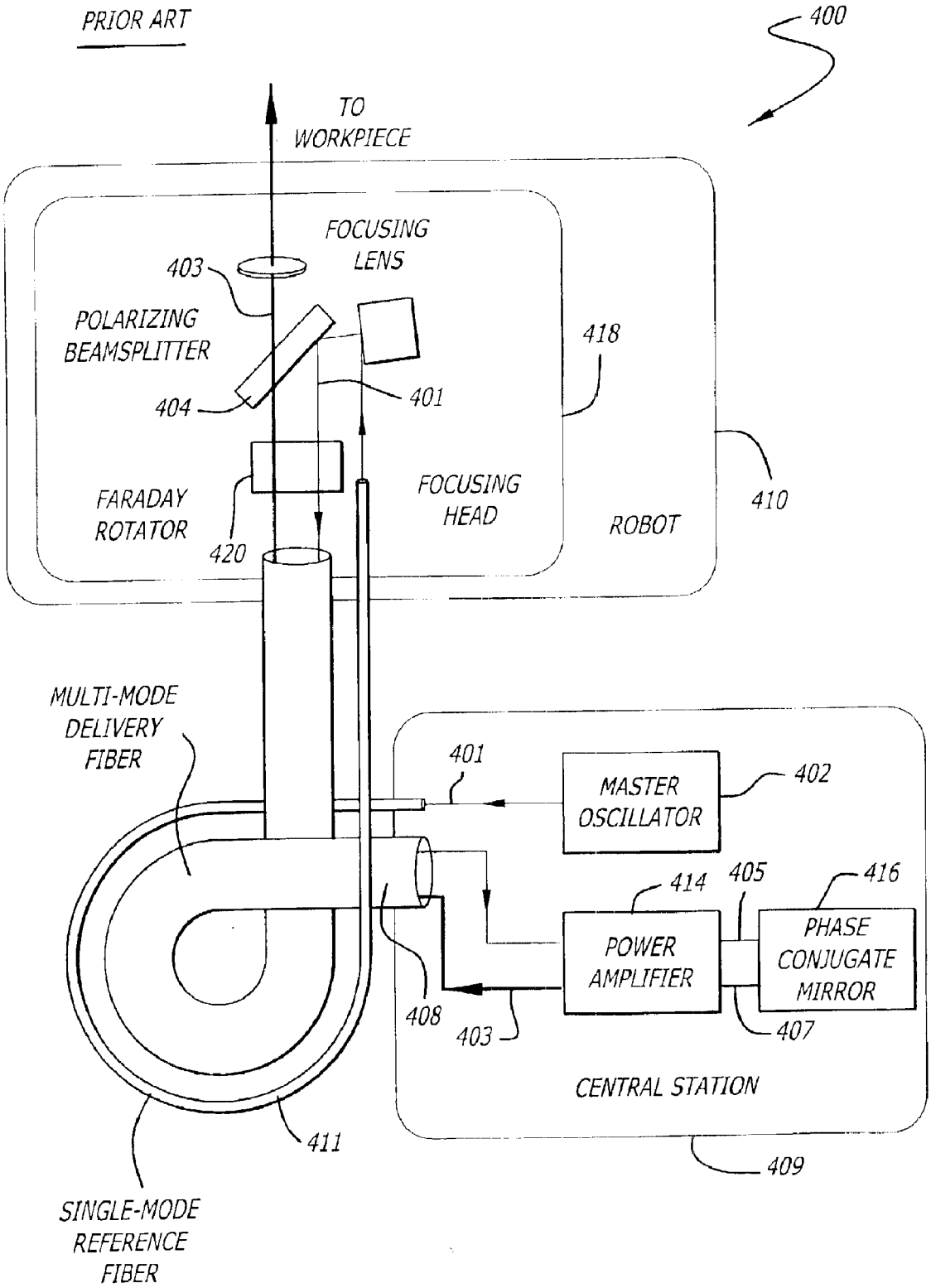
FIG. 4 PRIOR ART
FIG. 4 shows a fiber beam cleanup scheme implemented in accordance with conventional teachings.

FIG. 4 shows a fiber beam cleanup scheme disclosed by Rockwell and Bartelt in U.S. Pat. No. 5,208,699, entitled "Compensated, SBS-free Optical Beam Amplification and Delivery Apparatus and Method," the teachings of which are incorporated by reference herein. This system 400 may be used in a robotic industrial laser application in which a central station 409, containing a laser master oscillator 402, laser power amplifier 414, and phase conjugate mirror 416, delivers laser energy over a pair of optical delivery fibers 408 and 411 to the focusing head 418 of an industrial robot 410. The low power, high quality master oscillator beam 401 is delivered to the focusing head 418 through a low-power, single-mode, polarization-preserving optical fiber 411. This "reference" beam 401 is then reflected by a polarizing beamsplitter (outcoupler) 404 and the polarization is rotated by a non-reciprocal polarizing element, such as a Faraday rotator 420, having the property that after two opposite passes through the element, the polarization is rotated 90 degrees. The low power beam 401 is then coupled into a large multi-mode delivery fiber 408 and delivered back to the central station 409, where it is amplified on a first pass through the amplifier beamline 414. At this point the beam 405 is highly aberrated and depolarized due to optical phase distortions in the delivery fiber and power amplifiers. The beam 405 is then reflected by a vector phase conjugate mirror 416 that returns the phase conjugate of the incident wavefront with all polarization states remaining in the same phase relationship. The phase conjugated beam 407 then retraces its path to the focusing head 418, correcting for the optical distortions along the path. The amplified and corrected beam 403 then passes the non-reciprocal rotator and is outcoupled through the polarizing beamsplitter, emerging with essentially the same high beam quality as the reference beam 401 from the master oscillator 402.

The advantage of this scheme is that the high brightness laser beam can now be focused to a small spot on the workpiece, while simultaneously providing a deep focal region and long working distance. The simultaneous provision of a small focused beam size, deep focal region, and long working distance are advantageous for robotic metal cutting applications where narrow kerf width, long standoff distances, and relaxed proximity tolerances enable faster cutting speeds, simplify programming of robotic motion, and reduce debris back-spatter on focusing lenses.

Figure 5:
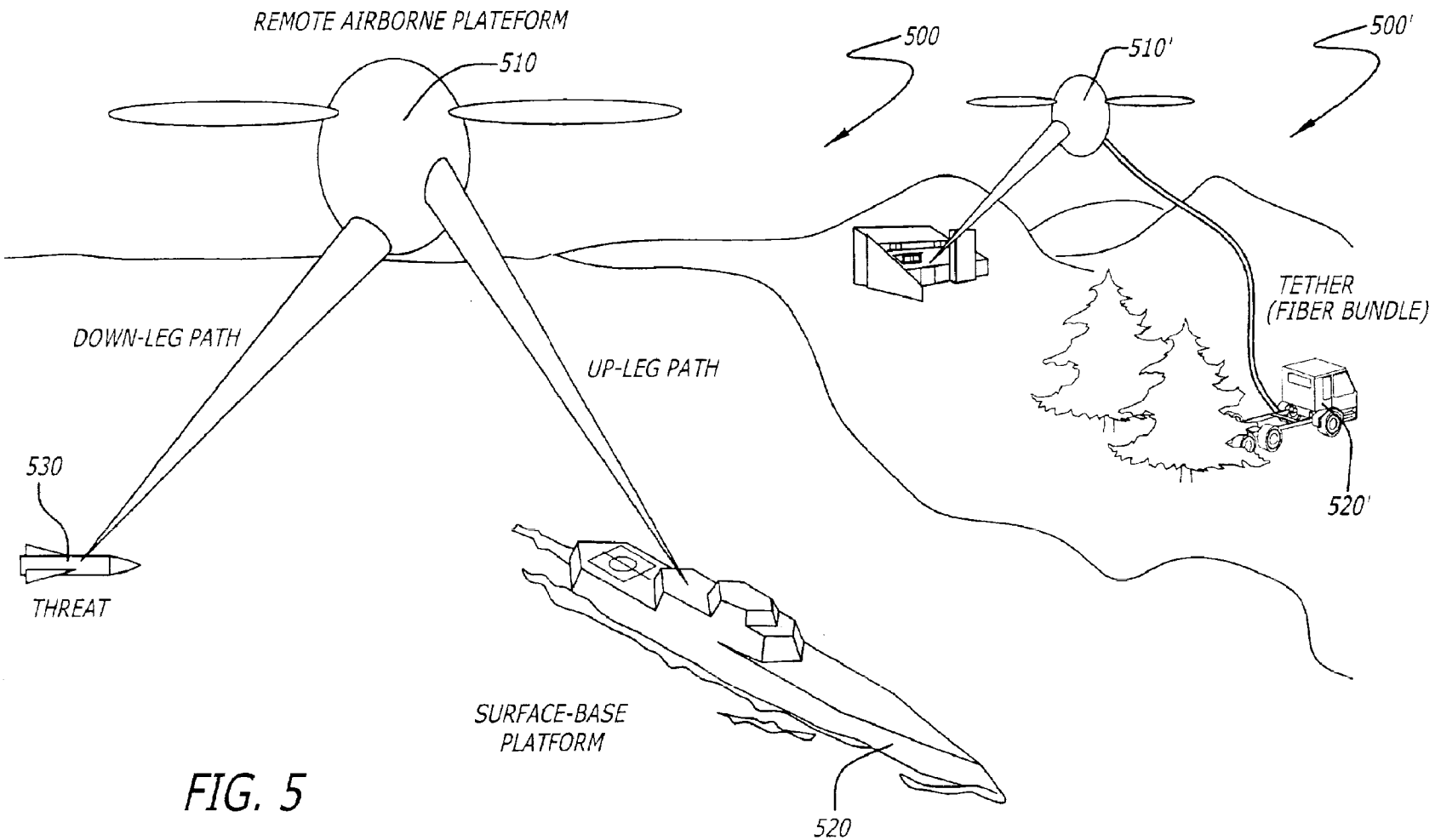
FIG. 5 is an operational diagram illustrating two applications of the teachings of the present invention.

FIG. 5 is an operational diagram illustrating two applications of the teachings of the present invention. The application illustrated on the left side of the figure is one in which several elements of a high-energy laser such as a master oscillator (MO), a tracker, and outcoupler (none of which are shown in FIG. 5) are integrated on a free-flying, unmanned platform 510 and a phase conjugate amplifier (not shown) is located on a second platform 520, e.g., a surface ship. This embodiment allows the HEL system 500 to engage anti-ship threats, such as sea-skimming cruise missiles 530, from above where the detection and engagement ranges are longer, the atmospheric turbulence and scattering is less, and the target is more vulnerable (side aspect).

An alternative application 500' is depicted in the right of the figure. Here, the remote elements are integrated on a tethered un-manned rotocraft platform 510' and the phase conjugate amplifier is located on a second platform 520', in this case a combat vehicle such as a High Mobility Multi-Wheeled Vehicle (HMMWV). This embodiment allows the HMMWV to engage air and ground targets while protected by terrain features and provides a much larger field of engagement than afforded by a ground-based system. The tether may carry a fiber optic cable or bundle, which provides a flexible optical path between the remote airborne platform and surface-based platform.

Figure 6:
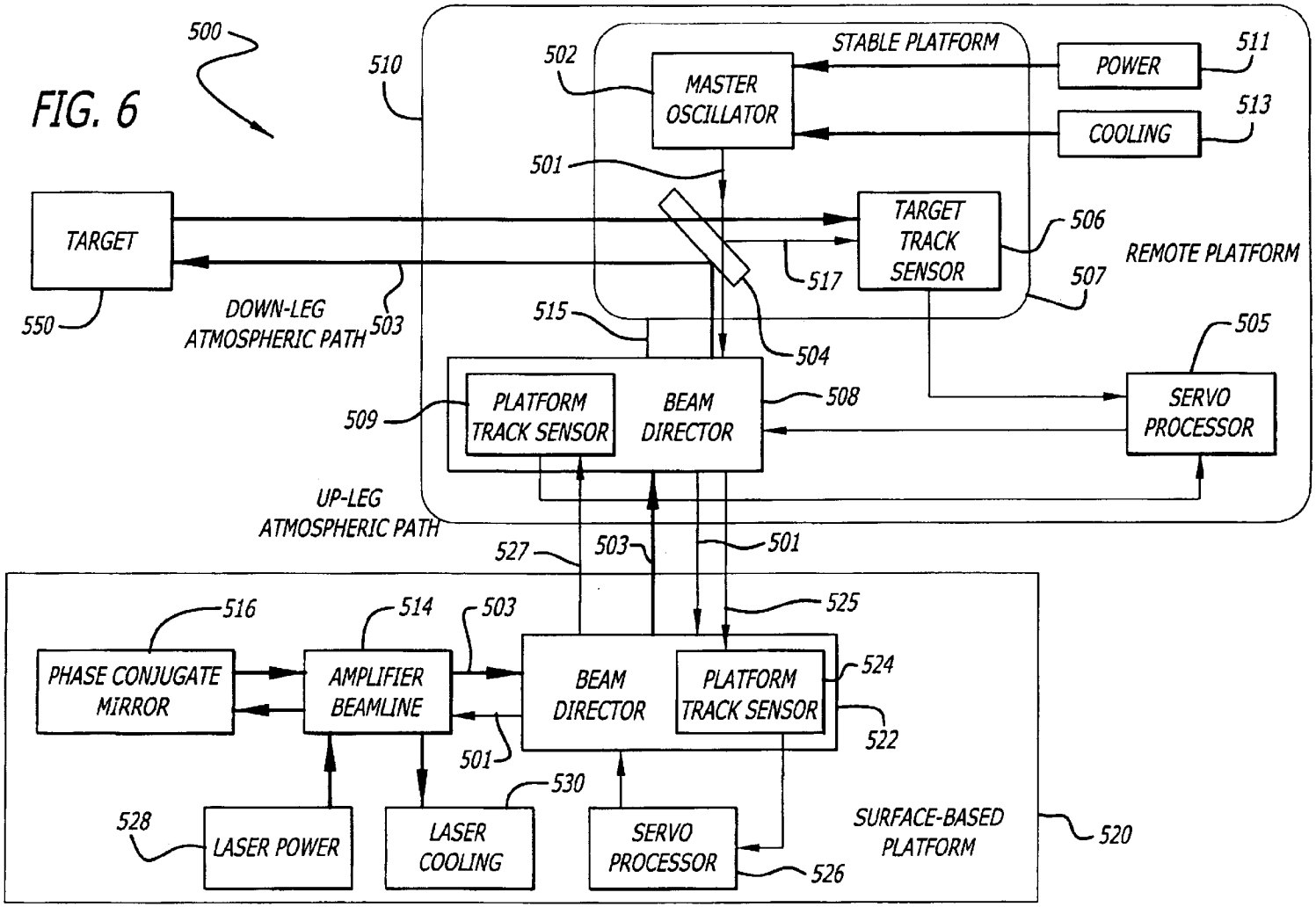
FIG. 6 is a block diagram showing an illustrative implementation of a phase conjugate relay mirror system implemented in accordance with the teachings of the present invention.

FIG. 6 is a block diagram showing an illustrative implementation of a phase conjugate relay mirror system implemented in accordance with the teachings of the present invention. In accordance with the present teachings, a lightweight and inexpensive relay mirror arrangement is located on a remote platform to redirect a high power electromagnetic (e.g. HEL) beam originating from a surface-based platform. While the invention is utilized in connection with a surface-based platform, those skilled in the art will appreciate that the invention is not limited thereto. The present teachings may be utilized with one or more platforms that are not located on a surface of a body without departing from the scope of the present teachings. As shown FIG. 6, in an illustrative embodiment of the invention, the system 500 includes a master oscillator (MO) 502, an outcoupler 504, and a target track sensor 506 mounted on a remote platform 510. The remote platform 510 may be an unmanned aerial vehicle (UAV), tethered rotocraft or aerostat, elevated boom attached to a surface vehicle, elevated mast portion of a surface ship, space vehicle, or any other suitable manned or unmanned structure, articulating member, or craft without departing from the scope of the present teachings. The master oscillator 502, outcoupler 504 and target track sensor 506 are located on a stable platform 507. A conventional power supply 511 and cooling unit 513 are provided for the master oscillator 502 off the stable platform 507. The system 500 further includes a first beam director 508 located on the remote platform 510. A platform track sensor 509 is located on the beam director 508. The stable platform 507 is articulated relative to the body axes of the remote platform 510 by the beam director 508 through a mechanical linkage 515. The stable platform 507 is pointed in the direction of a target 550 by the beam director 508 under the control of a conventional servo processor 505 which receives angular error signal inputs from the target track sensor 506 and the platform track sensor 509. The beam director 508 therefore serves to orient the stable platform 507 such that the target track sensor's (506) line-of-sight (LOS) is pointed precisely toward the target aimpoint.

The beam director 508 also functions to coarsely point the LOS of the master oscillator beam 501 toward the surface-based platform 520 by means of a first platform track sensor 509 located on. The target track sensor 506, master oscillator 502, and outcoupler 504 are configured and aligned such that the master oscillator beam 501, after reflecting off the outcoupler 504, is co-aligned with the target track sensor line-of-sight (LOS). In this configuration, when the target track sensor LOS is pointed at the target aimpoint, a HEL beam 503 that is propagating opposite the direction of the master oscillator beam 501 will, upon reflection off the outcoupler 504, be directed to the target aimpoint.

A second beam director 522 is located on the surface-based platform 520. The second beam director 522 coarsely points the LOS of a phase conjugate amplifier beamline, consisting of a series of laser power amplifiers (amplifier beamline) 514 and a phase conjugate mirror 516, toward the remote platform 510 under the control of a conventional servo processor 526 with input from a second platform track sensor 524. The phase conjugate mirror 516, ensures that the amplified HEL beam 503, after double-passing the up-leg atmospheric path, the optics within the two beam directors, and the amplifier beamline, will propagate opposite the direction of the master oscillator beam 501, thus satisfying the alignment condition described above.

The platform track sensors 509, 524 may use passive optical means to track the up-leg apertures of the surface-based platform 520 and remote platform 510, respectively; or may use active optical tracking means with the aid of additional optical alignment beams 525, 527 located on the beam directors 508, 522.

A conventional power supply 528 and a cooling unit 530 are provided for the amplifier beamline 514.

The embodiment of FIG. 6 may make use of the tracker auto-boresight approach described in Byren in above referenced U.S. Pat. No. 4,798,462 by using a portion 517 of the master oscillator beam 501 as the fudicial boresight reference. If the master oscillator 502 operating wavelength is not within the target track sensor's passband, a separate alignment beam that is within said passband may be integrated within the master oscillator 502 and serve the function of the boresight reference. This allows the master oscillator 502 to be removed and replaced with minimal optical alignment and also enhances alignment retention, particularly if the boresight source and master oscillator 502 share a common pre-expanding telescope.

This is believed to be the first application of nonlinear optical phase conjugation for correcting the up-leg path of a relay mirror HEL delivery system. It extends the self-aligning phase conjugate mirror concept disclosed by Byren and Rockwell in the above-referenced U.S. Pat. Nos. 4,798,462; 4,812,639; and 4,853,528, the teachings of which have been incorporated herein by reference, by including the surface-based amplifier beamline, up-leg atmospheric path, and relay mirror pointing within the compensated path of a phase conjugate mirror.

Figure 7:
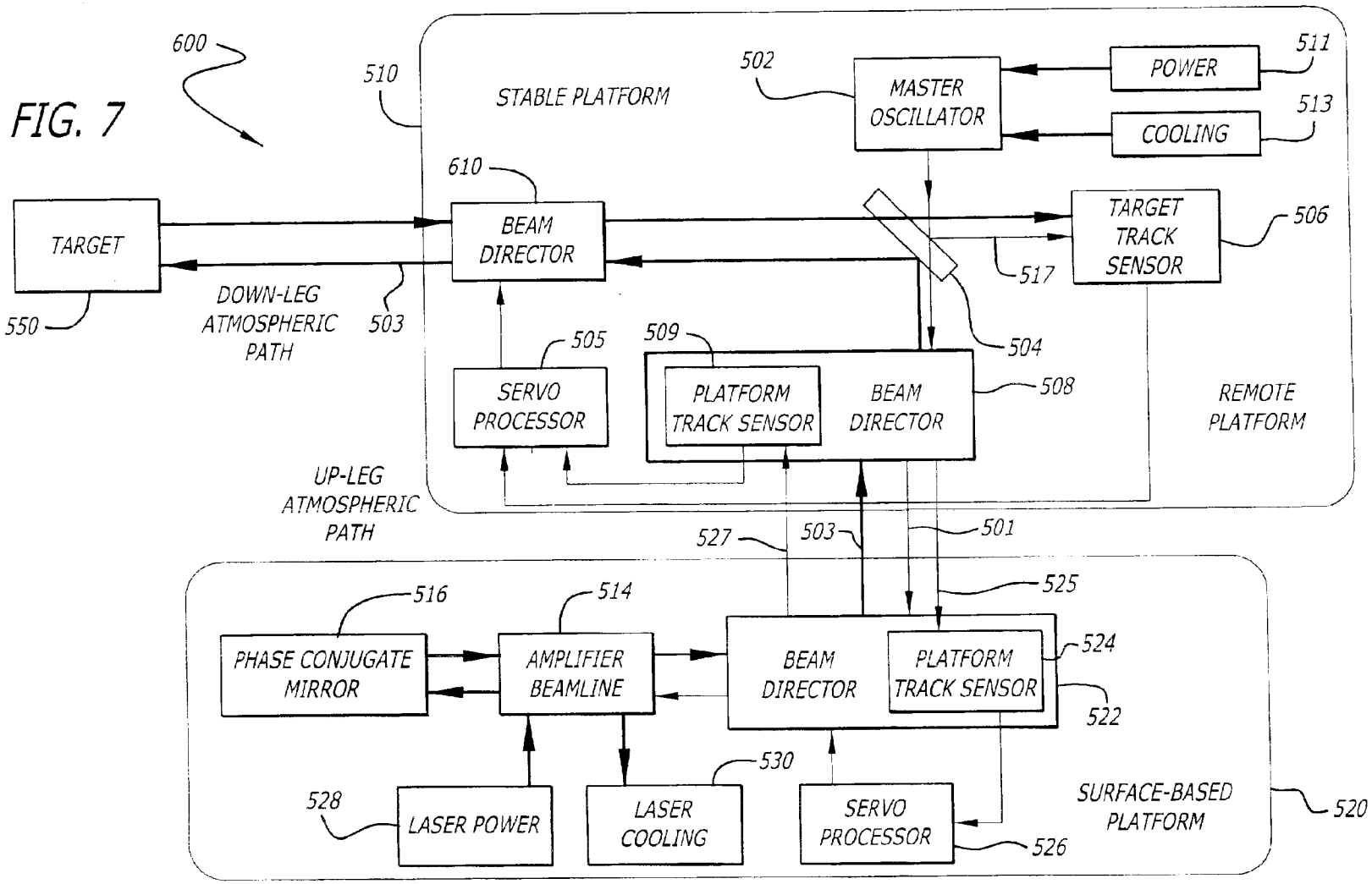
FIG. 7 shows an alternate embodiment of the invention, in which the master oscillator, target track sensor, and outcoupler are mounted directly on the remote platform, rather that on a stabilized platform that is articulated relative to the beam director.

FIG. 7 shows an alternate embodiment of the invention, in which the master oscillator, target track sensor, and outcoupler are mounted directly on the remote platform, rather that on a stabilized platform that is articulated relative to the beam director. This embodiment may be advantageous for some applications requiring master oscillator and/or target track sensor components that are large and heavy and therefore inconvenient to mount on-gimbal. In this embodiment, a second beam director 610 is used to direct the line-of-sight of the target track sensor and HEL beam to the target.

Figure 8:
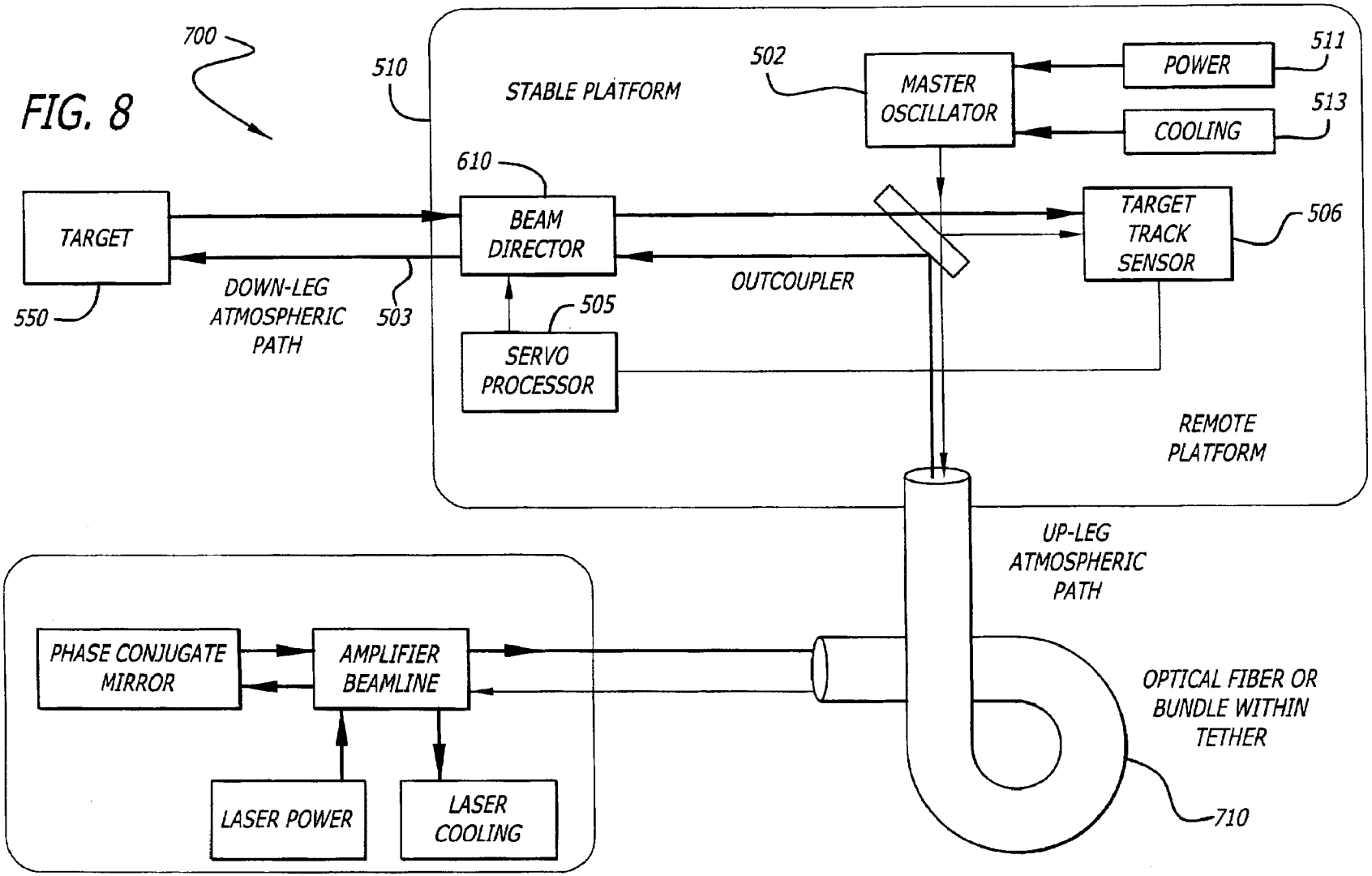
FIG. 8 shows a second alternate embodiment of the invention.

FIG. 8 shows a second alternate embodiment of the invention. In the embodiment of FIG. 8, an optical fiber 710 or bundle of optical fibers is used to guide the lines of sight of the master oscillator and high power beams across the up-leg atmospheric path. This embodiment eliminates the need for the platform track sensors and associated beam directors to perform coarse line-of-sight control over the up-leg atmospheric path. This is similar to the scheme disclosed by Rockwell and Bartelt in U.S. Pat. No. 5,208,699, the teachings of which have been incorporated herein by reference. However, this embodiment includes the fiber cable as part of the remote vehicle tether, a feature not shown, disclosed, nor anticipated by Rockwell and Bartelt.

The line-of-sight control, high-power optics, optical imaging, tracking, lasing, power generation, and cooling components and software as well as the HEL pointing and tracking techniques used in this invention, and illustrated in the above-referenced embodiments, may be a conventional design and construction.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A system for directing electromagnetic energy comprising:

a master oscillator for generating a beam of electromagnetic energy;

first means for amplifying said beam of electromagnetic energy to form an amplified beam;

second means for redirecting said amplified beam; and third means for correcting aberrations in said amplified beam introduced by said first means, wherein said first means is mounted on a first platform, and said master oscillator and said second means are mounted on a second platform, said second platform being mobile relative to said first platform.

2. The invention of claim 1 wherein said second means includes a relay mirror arrangement.

3. The invention of claim 2 wherein said second means includes a beam director.

4. The invention of claim 3 wherein said second means includes a platform track sensor.

5. The invention of claim 4 wherein said second means includes an outcoupler.

6. The invention of claim 5 wherein said beam director and said outcoupler are mounted for mutually independent articulation.

7. The invention of claim 5 wherein said relay mirror is integral with said outcoupler.

8. The invention of claim 1 wherein said second means includes first and second beam directors, said first beam director being adapted to receive said amplified beam and said second beam director being adapted to redirect said amplified beam.

9. The invention of claim 1 wherein said beam of electromagnetic energy is a laser beam and said first means includes a high-energy laser amplifier.

10. The invention of claim 9 wherein said third means includes a phase conjugate mirror in optical alignment with said laser amplifier.

11. The invention of claim 10 wherein said first means includes a beam director in optical alignment with said laser amplifier.

12. The invention of claim 11 wherein said first means further includes a platform track sensor.

13. The invention of claim 1 further including an optical fiber for coupling said amplified beam between said first platform and said second platform.

14. A system for directing electromagnetic energy comprising:

a master oscillator for generating a laser beam;

first means for amplifying said laser beam to form an amplified laser beam, said first means including:

a high-energy laser amplifier, and a phase conjugate mirror in optical alignment with said amplifier to correct aberrations in said amplified beam introduced by said amplifier; and second means for redirecting said amplified laser beam, said second means including:

a beam director and an outcoupler mounted for independent articulation relative to said beam director;

wherein said first means are mounted on a first platform, and said master oscillator and said second means are mounted on a second platform mobile with respect to said first platform.

15. A method for directing electromagnetic energy comprising the steps of:

generating a beam of electromagnetic energy on a second platform;

transmitting said beam of electromagnetic energy through a medium to a first platform;

amplifying said beam on said first platform to form an amplified beam;

correcting aberrations in said beam introduced by said amplifier;

transmitting said amplified beam from said first platform through said medium to said second platform; and redirecting said amplified beam from said second platform, said second platform being mobile relative to said first platform.

16. The method of claim 15 wherein the steps of transmitting said beam and transmitting said amplified beam comprise transmitting the beams through the atmosphere.

17. The method of claim 15 wherein the steps of transmitting said beam and transmitting said amplified beam comprise transmitting the beams through at least one fiber optic cable.

18. The method of claim 15 wherein the step of amplifying said beam includes correcting pointing and wavefront errors.

19. The invention of claim 1 wherein said means for correcting aberrations is a phase conjugate mirror.

20. The invention of claim 19 wherein said first means is an amplifier and said phase conjugate mirror is operationally coupled to the output thereof.

21. The invention of claim 15 wherein said step of correcting aberrations is performed with a phase conjugate mirror.

22. A system for directing electromagnetic energy comprising:

a master oscillator for generating a beam of electromagnetic energy;

first means amplifying said beam of electromagnetic energy to form an amplified beam;

second means for redirecting said amplified beam, said first means being mounted on a first platform, and said master oscillator and said second means being mounted on a second platform, said second platform being mobile relative to said first platform; and an optical fiber for coupling said amplified beam between said first platform and said second platform.

23. A method for directing electromagnetic energy comprising the steps of:

generating a beam of electromagnetic energy on a second platform;

transmitting said beam of electromagnetic energy through a medium to a first platform;

amplifying said beam on said first platform to form an amplified beam;

transmitting said amplified beam from said first platform through said medium to said second platform; and redirecting said amplified beam from said second platform, said second platform being mobile relative to said first platform, wherein the steps of transmitting said beam and transmitting said amplified beam comprise transmitting the beams through at least one fiber optic cable.

* * * * *